United States Patent [19]

Fabian et al.

[11] 4,088,558

[45] May 9, 1978

[54] METHOD OF RENEWING ELECTRODES

[75] Inventors: Peter Fabian, Freigericht; Ernst Jedlitschka, Bruchkobel; Helmut Krebs, Freigericht; Heinrich Simon, Langenselbold, all of Germany

[73] Assignee: Heraeus Elektroden GmbH, Hanau am Main, Germany

[21] Appl. No.: 833,878

[22] Filed: Sep. 16, 1977

[30] Foreign Application Priority Data

Sep. 22, 1976 Germany ..... 2642559

[51] Int. Cl.[2] ..... C25B 11/02; C25B 11/10; B23P 7/00

[52] U.S. Cl. ..... 204/288; 204/290 F; 29/401 R; 29/401 F; 29/592 R

[58] Field of Search ..... 204/284, 286, 204, 288, 204/289, 290 F; 29/401 R, 401 F, 592

[56] References Cited

U.S. PATENT DOCUMENTS

| | | | |
|---|---|---|---|
| 3,912,616 | 10/1975 | Ford | 204/286 |
| 3,925,886 | 12/1975 | Evans et al. | 29/592 X |
| 3,981,790 | 9/1976 | Olson et al. | 204/286 |
| 4,033,849 | 7/1977 | Pohto et al. | 204/286 |

FOREIGN PATENT DOCUMENTS

| | | | |
|---|---|---|---|
| 429,633 | 6/1935 | United Kingdom | 204/286 |

*Primary Examiner*—John H. Mack
*Assistant Examiner*—D. R. Valentine
*Attorney, Agent, or Firm*—Hammond & Littell

[57] ABSTRACT

A novel method of renewing electrode surfaces of metal electrodes with elongated supporting riser with at least the surface thereof being comprised of a valve metal or valve metal alloy supporting a generally planar electrode member with an electrocatalytic coating thereon.

8 Claims, 3 Drawing Figures

METHOD OF RENEWING ELECTRODES

STATE OF THE ART

U.S. Pat. No. 3,591,483 discloses the construction of a diaphragm-type electrolysis cell utilizing dimensionally stable anodes having a conductive, electrocatalytic coating thereon, which are connected to the cell base and a power supply source by means of a valve metal or a copper cored valve metal riser or conductor bar. In use, these anodes may be damaged by short circuits, physical distortion, coating wear and many other causes and are returned to the anode shop for repair and recoating.

The anode working face is usually constructed from expanded titanium mesh, titanium rods or titanium sheet material having a conductive, electrocatalytic coating thereon and is welded directly to the anode riser or conductor bar. If the anode or the coating became damaged or worn, it was considered necessary to entirely remove the anode from the anode riser and then repair and recoat the anode before replacement of the repaired or recoated anodes in an electrolysis cell. The recoating requires heating the working face from 300° to 500° C to cause the thermal decomposition of the coating material and to fix the coating on the anode face and if the anode face is welded to the riser or conductor bar before this heating, there is considerable distortion of the anode working face or destruction of the riser due to unequal heating of the working face and the riser and unequal expansion and contraction between these parts. Multiple coats are usully applied with heating between each coat, which multiplies the problem.

The risers or conductor bars are usually copper cored titanium tubes which are expensive and it is advantageous to be able to repair and/or recoat a previously used anode without destruction of the anode risers or conductor bars. However, the heat required for the thermochemical decomposition of the coating leads to considerable distortion of the anode faces which in the electrolysis cells must be substantially flat, since the copper cored riser acts as a "heat sink" and causes distortion of the recoated anode faces.

U.S. Pat. No. 3,940,328 describes a process for replacing electrode surfaces of this type by welding on an entirely new electrode surface with a fresh electrocatalytic coating thereon either over the old electrode surface or to a portion of the old electrode surface which results in a greater anode thickness which effects the electrode gap or by detaching the old electrode surfaces from the anode riser at their welded joints by chip removal means and turning the riser 90° before welding new electrode surfaces thereto.

OBJECTS OF THE INVENTION

It is an object of the invention to provide a novel process for renewing planar electrode surfaces in a simple and economical manner without effecting the electrode gap.

It is another object of the invention to provide novel electrodes produced by the said process.

These and other objects and advantages of the invention will become obvious from the following detailed description.

THE INVENTION

The novel method of the invention of renewing electrode surfaces of metal electrodes with an elongated supporting riser with at least the surface thereof being comprised of a valve metal or valve metal alloy supporting a generally planar electrode member with an electrocatalytic coating over at least a portion thereof comprises punching out or drilling out the weld joint-producing points of the planar electrode member to remove the planar electrode member, recoating the planar electrode member with a new electro-catalytic coating and spot welding the recoated planar electrode member to the supporting riser.

The method of the invention has the advantage that it is possible to reuse the same planar electrode member after recoating without any material losses and no additional shielding or the like are present and/or required which effect the electrode gap. Moreover, the apparatus used in the method are the same as that used to produce new electrodes and therefore, no special equipment is required.

The electrode riser is preferably a previously used anode conductor bar similar to the construction described in U.S. Pat. No. 3,591,483. These risers are usually constructed of a valve metal tube, such as titanium or tantalum and have a copper, sodium or aluminum core inside. The riser remains unchanged up to the rewelding of the planar electrode member to the sheet metal strips, profiles or angles on the riser. The method is particularly adapted for risers having a low melting good electrically conducting core such as copper since risers of this nature can not be subjected to the high temperatures used to form the electrocatalytic coating as it damages the bonding of the metals. Referring now to the drawings:

Figure 1:
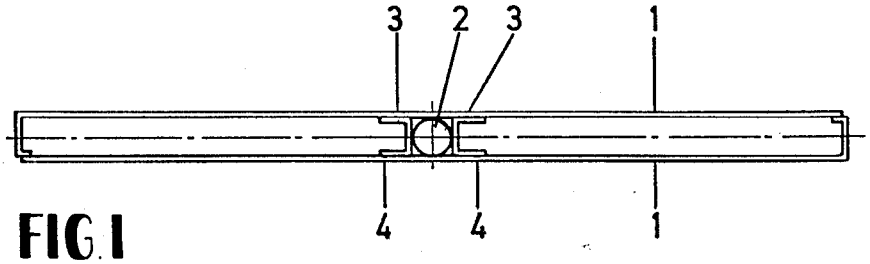
FIG. 1 is a top cross-sectional view of an electrode on which the method may be used with the electrode members being spaced from each other and FIG. 1*a* is a side view of the embodiment of FIG. 1.
Figure 1A:
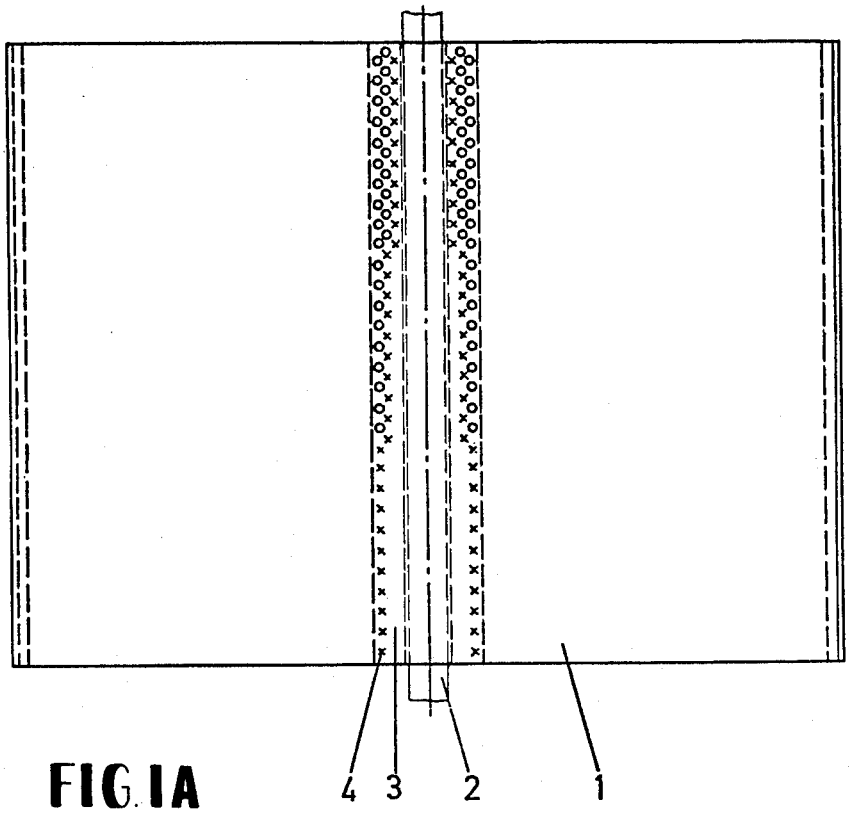

In the embodiment of FIGS. 1 and 1*a*, the electrodes are comprised of planar electrode members 1 arranged in a rectangular box shape around riser 2. U-shaped sheet metal elements 3 made of a valve metal such as titanium are welded to riser 2 and the electrode members 1 are connected to the legs of element 3 by means of spot welds 4 and the legs of element 3 are wide enough to accommodate several rows of welds 4. The elements 3 may have other profiles such as L- or Z-shaped.

The electrode members 1 may be in any planar form such as sheet but are preferably reticulated valve metal mesh made of valve metal or valve metal alloy such as titanium, tantalum or niobium which are not effected by the cell electrolysis conditions. Preferably, titanium is used because of the cost factor and availability.

Figure 2:
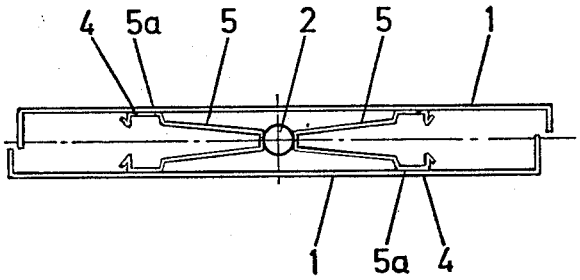
FIG. 2 is a top cross-sectional view of a second type of electrode on which the method may be used.

In the embodiment of FIG. 2, the electrode members 1 are spot welded to connecting element 5 at end areas 5*a* which are wide enough to accommodate several rows of spot welds 4. The elements 5 are preferably arranged symmetrically between riser 2 and planar electrode members 1 and elements 5 may have an elastically flexible or spring loaded construction or may be moveably mounted or guided in springs or holders not shown.

In each of the embodiments the valve metal members 1 in reticulated mesh, rod or other form are provided with an electrically conducting electrocatalytic coating which is applied and baked on as described, for example, in U.S. Pat. Nos. 3,632,498 and 3,711,385, so that the reconstructed and recoated anodes do not have to be heated after the added portions are attached to the anode risers or the portions of the previously used anode envelopes or working faces which are attached to the risers.

Although the present invention has been described in connection with a few preferred embodiments thereof, variatons and modifications may be resorted to by persons skilled in the art without departing from the principles of the invention or the scope of the accompanying claims.

We claim:

1. A method of renewing electrode surfaces of metal electrodes with an elongated supporting riser with at least the surface thereof being comprised of a valve metal or valve metal alloy supporting a generally planar electrode member with an electrocatalytic coating over at least a portion thereof comprising punching out or drilling out the weld joint-producing points of the planar electrode member to remove the planar electrode member, recoating the planar electrode member with a new electrocatalytic coating and spot welding the recoated planar electrode member to the supporting riser.

2. The method of claim 1 wherein the planar electrode member is spot welded to an intermediate profiled element attached to the riser.

3. The method of claim 2 wherein the profiled element is of sufficient width to accomodate several rows of spot welds.

4. The method of claim 1 wherein the planar electrode member is made of a valve metal.

5. The method of claim 2 wherein the profiled element is spring loaded.

6. The method of claim 1 wherein the planar electrode member is a valve metal mesh.

7. The process of claim 4 wherein the valve metal is titanium.

8. A reconstructed electrode produced by the method of claim 1.

* * * * *